US006024634A

United States Patent [19]

Höglund et al.

[11] Patent Number: 6,024,634

[45] Date of Patent: Feb. 15, 2000

[54] GRINDING PRODUCT AND METHOD OF MAKING SAME

[75] Inventors: Göran Höglund, Jakobstad; Hans Hede, Vörå, both of Finland

[73] Assignee: OY KWH Mirka AB, Jeppo, Finland

[21] Appl. No.: 08/811,769

[22] Filed: Mar. 6, 1997

Related U.S. Application Data

[63] Continuation of application No. PCT/FI95/00471, Sep. 5, 1995.

[30] Foreign Application Priority Data

| | | | |
|---|---|---|---|
| Sep. 6, 1994 | [FI] | Finland | 944090 |
| Oct. 28, 1994 | [FI] | Finland | 945090 |

[51] Int. Cl.[7] ..... B24D 11/00

[52] U.S. Cl. ..... 451/532; 451/526; 451/539

[58] Field of Search ..... 51/294, 295; 451/526, 451/527, 528, 530, 532, 533, 534, 536, 537, 538, 539

[56] References Cited

U.S. PATENT DOCUMENTS

| | | | |
|---|---|---|---|
| 1,850,413 | 3/1932 | Porte | 451/536 |
| 1,961,911 | 6/1934 | Pusch | 451/536 |
| 2,123,581 | 7/1938 | Anderson | 451/536 |
| 2,540,112 | 2/1951 | Goepfert et al. | 451/536 |
| 2,672,715 | 3/1954 | Walters . | |
| 2,682,733 | 7/1954 | Buckner . | |
| 2,682,735 | 7/1954 | Buckner | 451/536 |
| 2,984,052 | 5/1961 | Mueller . | |
| 3,284,963 | 11/1966 | Lanham et al. | 451/532 |
| 3,324,609 | 6/1967 | Stein . | |
| 3,822,517 | 7/1974 | Moss | 451/532 |
| 3,976,525 | 8/1976 | Mednick . | |
| 4,018,575 | 4/1977 | Davis . | |
| 4,142,334 | 3/1979 | Kirsch . | |
| 4,437,269 | 3/1984 | Shaw . | |
| 4,645,699 | 2/1987 | Neveu . | |
| 4,991,362 | 2/1991 | Heyer . | |
| 5,013,330 | 5/1991 | Durkin . | |
| 5,025,596 | 6/1991 | Heyer . | |
| 5,131,924 | 7/1992 | Wiand . | |
| 5,254,194 | 10/1993 | Ott et al. | 451/532 |
| 5,674,122 | 10/1997 | Krech | 451/536 |
| 5,692,949 | 12/1997 | Sheffield et al. | 451/539 |

FOREIGN PATENT DOCUMENTS

| | | |
|---|---|---|
| 0 064 748 | 11/1982 | European Pat. Off. . |
| 0 166 060 | 1/1986 | European Pat. Off. . |
| 87151 | 12/1992 | Finland . |
| 95063 | 8/1988 | Romania . |
| 1 137 556 | 12/1968 | United Kingdom . |
| 1 539 477 | 1/1979 | United Kingdom . |
| 2 162 213 | 1/1986 | United Kingdom . |
| 2 199 053 | 6/1988 | United Kingdom . |
| WO 90/14039 | 11/1990 | WIPO . |

*Primary Examiner*—David A. Scherbel
*Assistant Examiner*—Derrie Holt Banks
*Attorney, Agent, or Firm*—Merchant & Gould P.C.

[57] ABSTRACT

A grinding product and a method of making same. The grinding product comprises a woven or knitted cloth of multifilament threads (1) whose fibers (2) form projecting loops (3), and separate agglomerates (4) of grinding material applied to the loops. During the grinding, different sides of the agglomerates (4) come into contact with the surface to be ground, which prolongs the service life of the grinding product. The agglomerates also form a gap between the cloth and the surface to be ground, through which gap the grinding dust can be removed.

6 Claims, 5 Drawing Sheets

GRINDING PRODUCT AND METHOD OF MAKING SAME

This is continuation of Application Number PCT/FI95/00471 filed Sep. 5, 1995.

FIELD OF THE INVENTION

The present invention relates to a grinding product comprising a cloth of woven or knitted threads and a grinding agent applied to the cloth. The invention also relates to a method of making a grinding product.

BACKGROUND OF THE INVENTION

The main reason for the fact that the grinding effect of a grinding product decreases and finally disappears altogether is that dust from the ground material blocks the product. In conventional grinding products comprising a paper, plastic or woven layer to which abrasive grit particles are applied using a binding agent, different measures have been taken to slow down the blocking rate. For example, the grit density on the surface of the grinding product has been varied, different types of binding agents have been used, a stearate layer has been spread on the grinding product to provide a dust-repellent surface, and the grinding product has even been perforated such that it has been possible to suck the dust through the grinding machine or grinding block at certain points during the grinding.

These known methods, however, have only a slight effect on the blocking rate. For example, the last-mentioned perforated grinding product has the drawback that since the product as such is impervious to air and since during the grinding the product is situated against the surface to be ground, there is very little space for the air streams that should take the dust away.

One known grinding product with improved conveyance of grinding dust as compared with the above conventional products comprises a relatively thick, randomly needle-punched layer of nylon fibres. The product has an open, elastic structure. Using the product, the grinding pressure is even, and the mutual movement of individual threads during the grinding helps to prevent dust from fastening to the product. The connecting manner, however, makes the grinding surface of the nonwoven product uneven and irregular, and the large thickness makes the product bulky and rigid.

U.S. Pat. No. 4,437,269 shows a grinding product comprising a paper layer, a grinding agent being attached to one side of the product, and a fabric being adhered to the other. The free surface of the fabric is raised to form fibre loops or ends by means of which the grinding product can be detachably attached to a supporting surface provided with means, such as hooks or mushroom-like pins, that grip the loops of the cloth. The raised surface of the cloth makes it possible to attach the grinding product to and detach it from the supporting surface in a very quick and simple manner, the supporting surface forming e.g. part of a grinding tool.

U.S. Pat. No. 3,324,609 teaches a grinding product in which a layer of nonwoven fibres is attached to a cloth of woven fibres. A grinding agent is applied to the free surface of the nonwoven layer. The nonwoven layer is attached to the cloth by means of fibres that extend through the cloth and have lumps—produced by heating—at the ends for attaching the fibres to the cloth.

The above known structure has certain drawbacks. For example, the grinding product of the citation becomes rather rigid partly because the nonwoven layer must be rigid to be able to carry the grinding agent, and partly because of the lumps at the ends of the fibres on the other side of the cloth, molten together to some extent. The grinding product is thus relatively rigid.

In addition, production of a grinding product according to U.S. Pat. No. 3,324,609 is very complicated. A nonwoven layer with an even surface on one side and an uneven surface with projecting fibres on the other side is produced first. Then a loose fabric is produced, and the nonwoven layer is placed on the cloth such that some of the fibres of the layer penetrate through the cloth. Finally, a flame is directed towards the cloth so that the ends of the fibres projecting from the cloth melt, forming lumps. It is also to be noted that the lumps at the ends of the fibres effectively hinder conveyance of air and dust through the cloth.

SUMMARY OF THE INVENTION

The object of the present invention is to provide a grinding product that has—because of its good resistance to the blocking effect of the grinding dust—a considerably longer service life than the known grinding products.

One aspect of the invention is a grinding product comprising: a cloth of woven or knitted threads; thread parts, such as loops or thread ends, situated on one surface of the cloth and projecting from the cloth; and a grinding agent applied as separate agglomerates to that surface of the grinding product which comprises projecting thread parts, at least to the projecting thread parts. The grinding product is characterized in that the projecting thread parts comprise loops or ends of threads of the cloth.

As compared with the previously known products, it is advantageous in many ways that the projecting thread parts consist of the threads of the cloth. The grinding product of the invention is thus very flexible, since the product does not contain a binding agent for attaching separate threads to the cloth. Flexibility is a clear advantage is many grinding situations. In addition, the absence of a binding agent and the fact that the cloth has an open structure make it easy to remove the grinding dust from the surface that is ground through the grinding product. Since the projecting thread parts are pliable, different parts of the agglomerates of grinding material come into contact with the surface that is ground when the direction or the strength of the grinding force is changed, which partly prolongs the useful life of the grinding agent and partly helps to convey dust. In addition, the threads in the woven or knitted cloth are readily moveable in relation to one another, which enhances conveyance of grinding dust through the product. A cloth produced in this manner has also an elastic and even surface, which improves the quality of the surface that is ground. The thin and flexible grinding product of the invention can be easily bent, machined and laminated with other materials.

An even more flexible grinding product is obtained if the projecting parts are formed of fibres from those threads of which the cloth is made.

In a preferred embodiment, the grinding agent is applied primarily, preferably only, to the thread parts projecting from the cloth, whereby the dust can be removed the most easily.

A further aspect of the invention is a grinding product comprising: a cloth of woven or knitted threads; thread parts, such as loops, situated on one surface of the cloth and projecting from the cloth; and a grinding agent applied as separate agglomerates at least to the other, essentially even surface of the cloth. The grinding product is characterized in that the projecting thread parts comprise loops of threads contained in the cloth, or of fibres of such threads.

Dust can thus be effectively conveyed from the surface to be ground through the cloth and further along the gap formed between the cloth and the supporting surface to which the cloth can be attached by means of the projecting thread parts of the cloth. In this embodiment, the projecting thread parts of the cloth thus form a gap for conveyance of grinding dust.

Another aspect of the invention is a grinding product comprising: a cloth of woven or knitted threads; thread parts, such as loops or thread ends, projecting from the cloth; and a grinding agent applied as separate agglomerates at least to the projecting thread parts. The grinding product is characterized in that projecting thread parts are arranged on both surfaces of the cloth, that they comprise loops or ends of threads contained in the cloth, and that a grinding agent is applied to the projecting thread parts at least on one surface of the cloth.

If a grinding product produced in this manner is coated with a grinding agent on its one side only, the projecting thread parts on the other surface can be utilized in detachably attaching the grinding product to a supporting surface. If, however, a grinding agent is applied to both surfaces of the cloth, a soft and flexible grinding cloth with two grinding surfaces and a long service life is obtained.

In certain applications, the grinding product is required to have a higher tensile strength or rigidity than a cloth has. In such cases, it is possible to attach a reinforcing layer to that surface of the cloth that is free of grinding material.

If one wants to make the grinding product thicker to obtain a better grip on it, or if the product is to absorb water, it is possible to attach a liquid-absorbing layer, such as a foam plastic layer, to that surface of the cloth that is free of grinding material.

Yet another aspect of the invention is a grinding product which is characterized in that the cloth is a spacer fabric known per se, comprising two essentially parallel woven or knitted surface layers spaced from each other, and connecting threads that connect the surface layers to each other and that are essentially perpendicular to them, and that the grinding agent is applied in the form of separate agglomerates at least to one surface layer of the cloth.

Since the cloth consists of a spacer fabric with relatively loosely arranged connecting threads between the surface layers and since the grinding agent is in the form of primarily separate agglomerates, the grinding dust can be easily conveyed from the grinding point through the surface layer on which the grinding agent is provided to the space between the surface layers and, if necessary, removed through the edges of the cloth. The grinding dust can be conveyed through the cloth using air streams. Despite its relatively large thickness, a cloth with such a structure can be made very soft and flexible, which is advantageous especially when curved surfaces are ground.

The invention also relates to a method of making a grinding product by providing at least one surface of a cloth comprising woven or knitted threads with thread parts, such as loops or thread ends, that project from the cloth, and applying a grinding agent comprising separate agglomerates of grinding material at least to one surface of the grinding product. The method is characterized in that the projecting thread parts are formed by the threads of the cloth or fibres of such threads e.g. by raising or weaving.

BRIEF DESCRIPTION OF THE DRAWINGS

In the following the invention will be described in greater detail with reference to the attached drawings, in which.

DETAILED DESCRIPTION OF PREFERRED EMBODIMENTS

Figure 1:
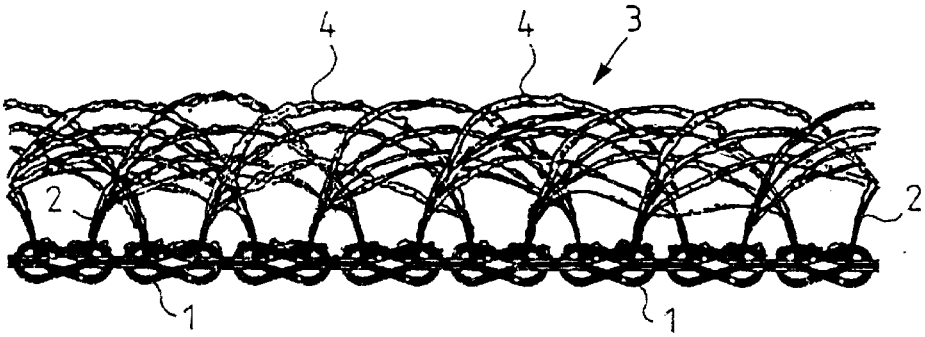
FIG. 1 shows an about 50 times enlarged cross-sectional view of a grinding product according to the invention.
Figure 2:
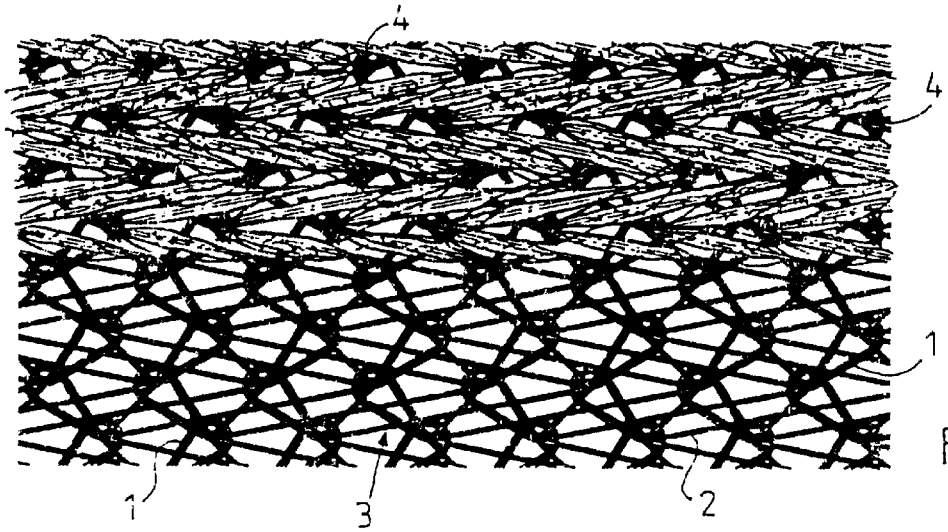
FIG. 2 shows a planar view of the grinding product shown in FIG. 1, FIGS. 3 and 4 show corresponding views of another embodiment of the invention.

FIGS. 1 and 2 show a piece of cloth woven from multifilament type threads 1. The number of fibres and filaments per one thread 1 can vary, but it is typically from 10 to 30. The Figures show that the cloth has an open, web-like structure that is pervious to both air, liquid and dust. One or more fibres 2 of the threads project at some points above the threads forming curved loops 3 that project from the cloth. These loops can be formed in many different ways, e.g. in connection with weaving or knitting the cloth. Usually, however, the loops are formed after the cloth has been made, e.g. by raising, carding or brushing the relevant surface of the cloth.

In accordance with FIGS. 1 and 2, at least some of the loops 3 are coated with separate agglomerates 4 of grinding material. For the sake of clarity, agglomerates are shown only in the upper part of FIG. 2. The grinding agent is attached to the loops 3 using a binding agent, such as phenol, epoxy, urethan or polyester. The expression 'separate agglomerates' means that the grinding product of the invention does not comprise a continuous grinding or binding agent layer that would cover the surface of the cloth and be impervious e.g. to air and grinding dust, but instead the grinding agent forms small point- or line-shaped accumulations that as a rule are separate from one another, and so the positions of the agglomerates in relation to the cloth may be different. The abrasive grit particles can consist of some known material, such as aluminium oxide or silicon carbide, and the material can be applied to the cloth in different ways, e.g. by spraying, by dipping the cloth in a suspension of a grinding agent, or with a roller. As the grinding agent is primarily applied to the projecting parts of the cloth, application of the grinding agent is simple, and a grinding product with a very high grinding capacity is obtained. Thus the structure of the cloth is utilized to facilitate application of the grinding agent.

Figure 3:
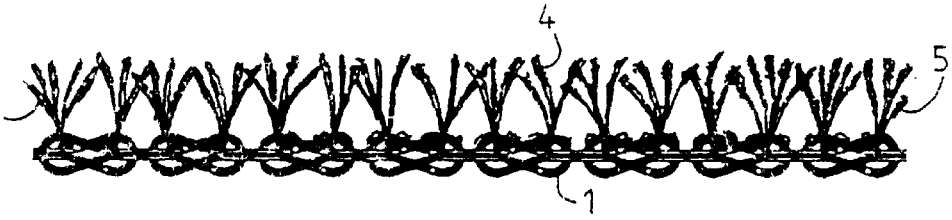
Figure 4:
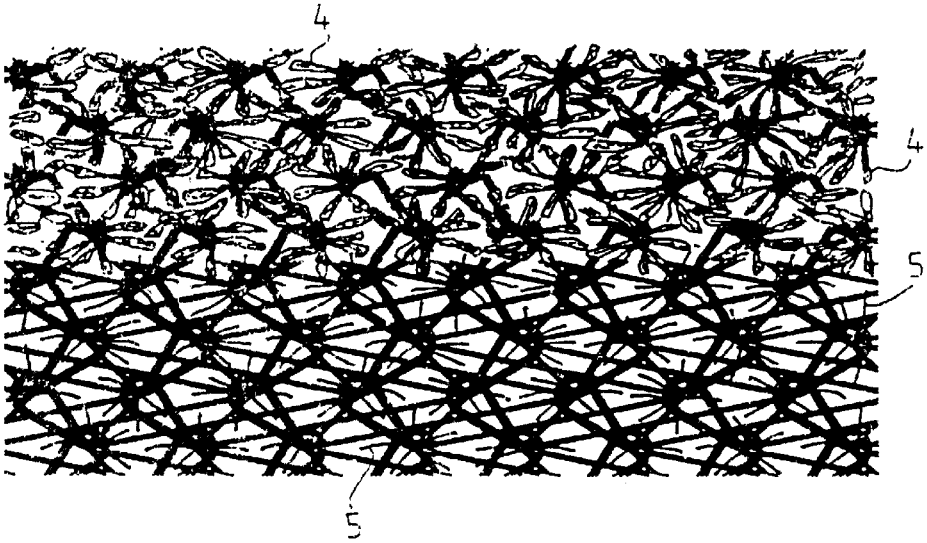

FIGS. 3 and 4 show a piece of a fabric in a corresponding manner as FIGS. 1 and 2. Instead of loops 3, the cloth here comprises fibre ends 5 projecting from the fabric; they have been produced by cutting the loops and are coated with agglomerates 4 of grinding material. It is easy to see that the agglomerates 4 of grinding material are here even freer to move in relation to the cloth than in the embodiment of FIG. 1.

Figure 5:
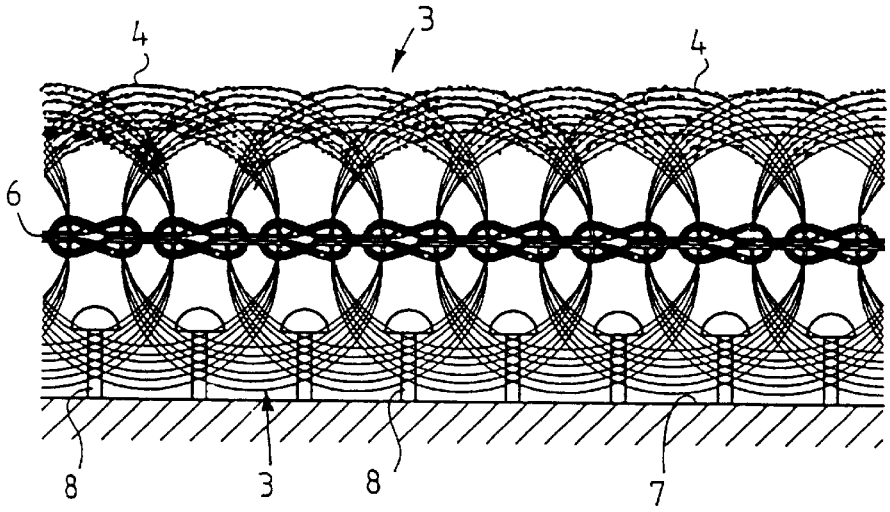
FIGS. 5 to 7 show cross-sectional views of different embodiments of the grinding product according to the invention, FIGS. 8 and 9, respectively, show a cross-sectional view and a planar view of yet another embodiment of the grinding product according to the invention.

FIG. 5 is a cross-sectional view showing the general structure of one embodiment of the grinding product according to the invention. The woven cloth contained in the grinding product is indicated by reference number 6. On both surfaces of the cloth there are fibre loops 3, but only the loops situated on the upper surface of the cloth in FIG. 5 are coated with a grinding agent 4. The loops 3 on the lower surface of the cloth function as fastening means as the grinding product is detachably attached to a supporting surface 7 that is provided with suitable fastening means, such as pins 8 provided with a head. The supporting surface can be situated on a block or a rotating plate in a grinding machine.

Figure 6:
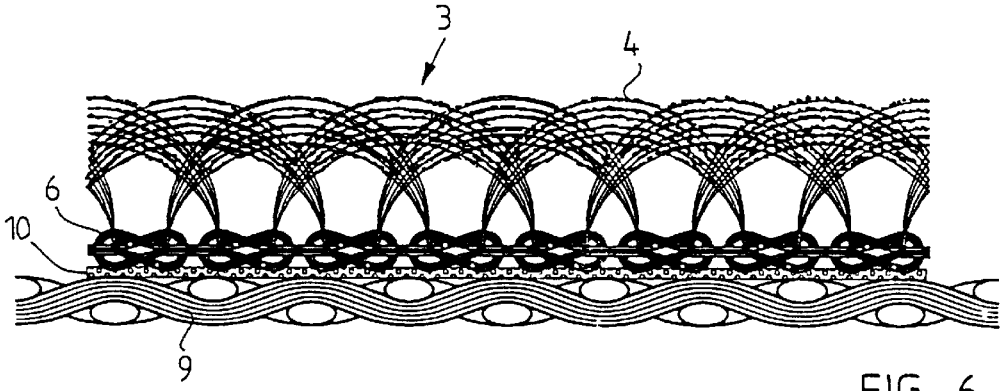

FIG. 6 shows a similar view as FIG. 5 of a grinding product having loops 3 only on one surface of the cloth. The loops are coated with a grinding agent 4, and the surface of the cloth 6 that is free of grinding material bears on a reinforcing layer 9, preferably a fabric, to which it is attached by means of a binding agent layer 10; the binding agent is applied to the binding agent layer e.g. at certain points or in the form of a web e.g. in such a way that the layer becomes pervious. The reinforcing layer can comprise a paper or cloth that gives the grinding product the desired tensile strength and/or rigidity.

Figure 7:
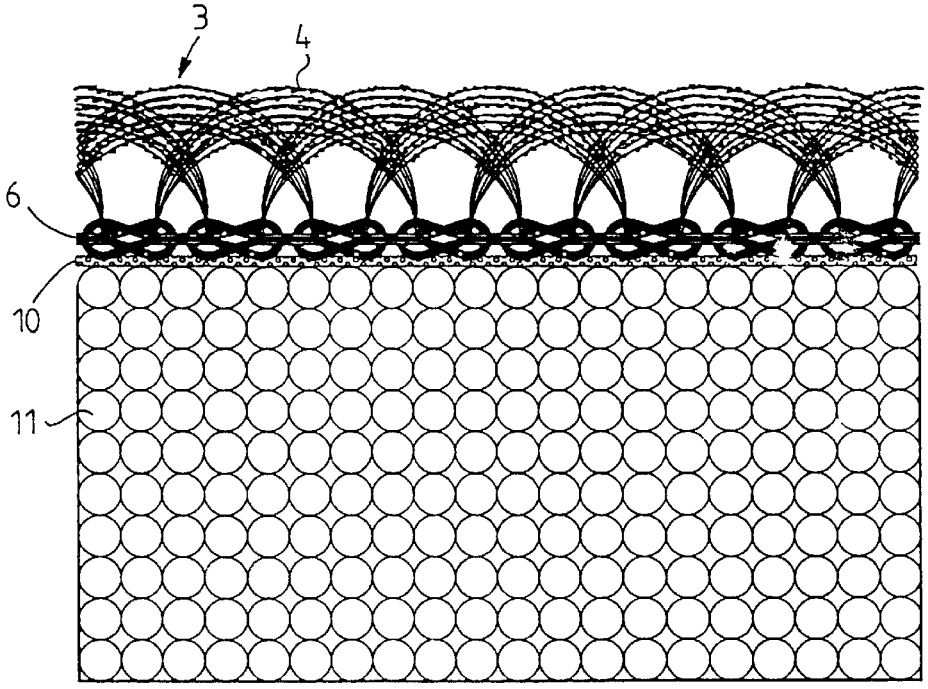

FIG. 7 shows a cloth that has the same structure as in FIG. 6 and is attached to a liquid-absorbing layer, such as a foam plastic layer 11, at its even surface, which is free of grinding material. The liquid-absorbing foam plastic layer makes it possible to convey liquid to the grinding point during the grinding, which often improves the grinding result. The liquid also helps to take away the dust during the grinding.

Figure 8:
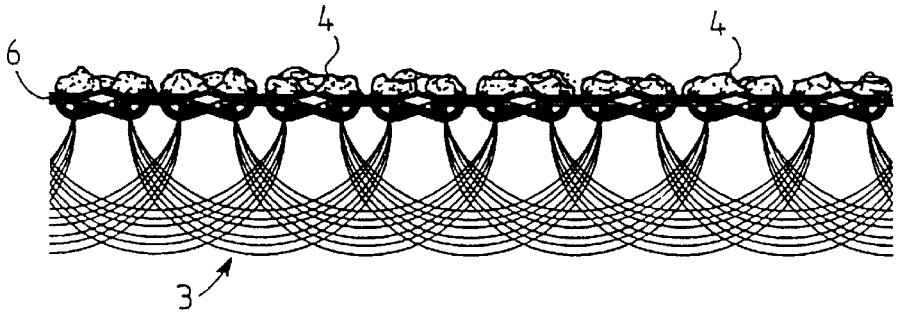
Figure 9:
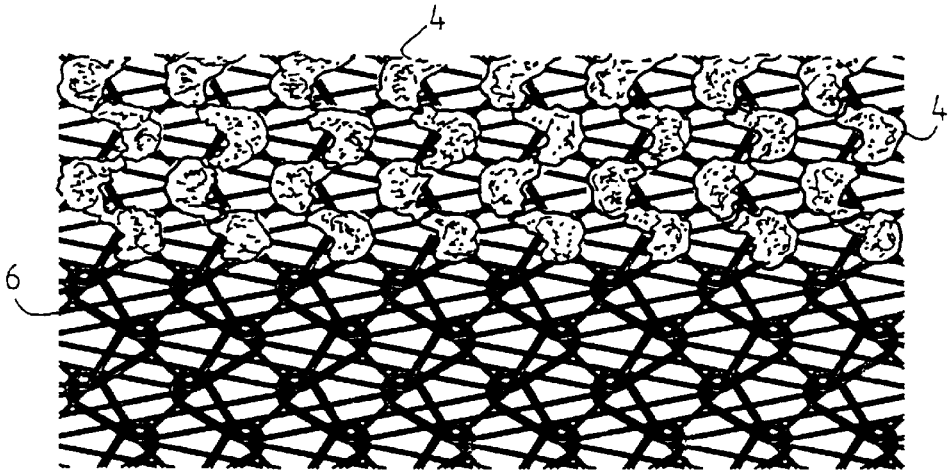

FIGS. 8 and 9 show a general view of an especially preferred embodiment of the present invention. The cloth 6 here comprises loops 3 on its one surface, and separate agglomerates 4 of grinding material are applied to the other surface of the cloth, which does not comprise any projecting parts and is therefore relatively even. A gap along which the grinding dust is removed from the grinding point is here not provided between the cloth and the surface to be ground, but between the cloth and the supporting surface (not shown in FIG. 8) provided with fastening means. The grinding product and the supporting surface are attached to each other by means of loops 3, and so the cloth 6 and the supporting surface are spaced apart. Further, the separate agglomerates 4 of grinding material and the loose, air- and dust-pervious cloth do not hinder the dust in any way.

A grinding agent can also be applied to the surface of the cloth that is provided with loops. This produces a double-sided grinding product whose even surface has a stronger grinding effect than the surface provided with loops.

Figure 10:
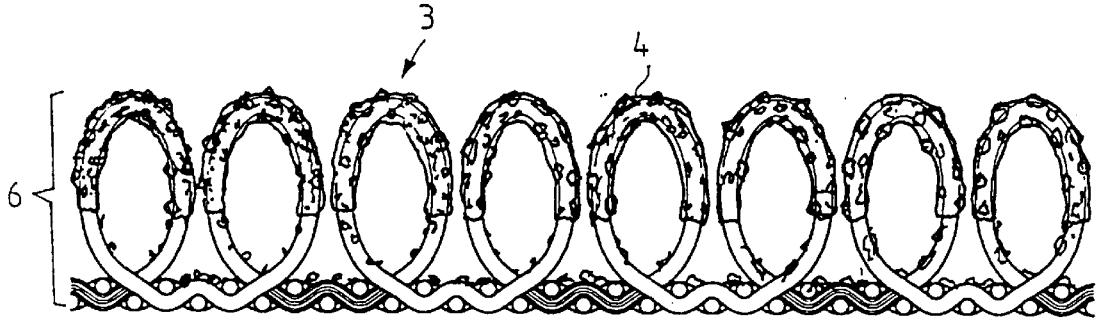
FIGS. 10 to 12 show, in cross-section, three variants of still another embodiment of the grinding product according to the invention.

FIG. 10 shows yet another embodiment of the grinding product according to the invention. Some of the threads of the cloth are arranged to form relatively rigid loops 3 projecting from the cloth. Since the loops are rigid, they can be regarded as part of the cloth 6. Preferably, the loops here consist of a monofilament thread. The cloth is thus loose and voluminous, so that air, liquid and dust can pass through easily. The separate agglomerates 4 of grinding material are applied to the loops situated on one surface. This kind of grinding product with a woven or knitted cloth is very soft and pliable, and allows effective removal of grinding dust through the cloth partly because the cloth as such is loose, whereby channels are formed in the cloth and dust can pass therethrough, and partly because the threads can easily move in relation to one another in a cloth like this. Preferably, the thickness of the cloth is at least three times that of the thread.

Figure 11:
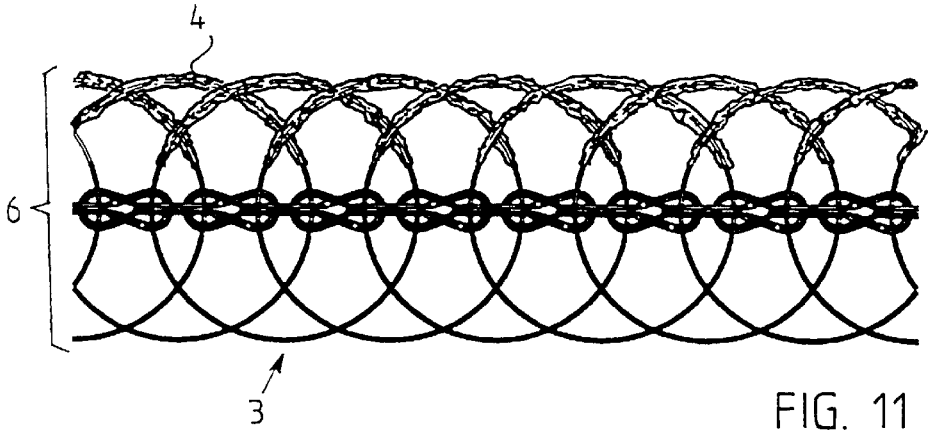

In FIG. 11, monofilament threads form rigid loops 3 on both sides of the cloth, whereas only one surface of the cloth 6 is coated with a grinding agent 4.

Figure 12:
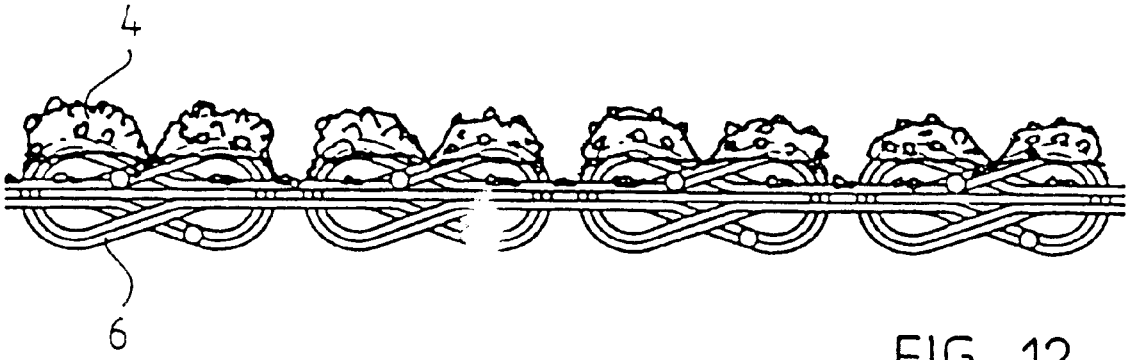

FIG. 12 shows yet another possible loose and voluminous cloth 6 coated with separate agglomerates of grinding material. Here the cloth is so loose that it comprises a large number of channels for conveying the grinding dust. The figure shows that the grinding agent 4 is applied to the projecting parts of the knots on one surface of the cloth.

Figure 13:
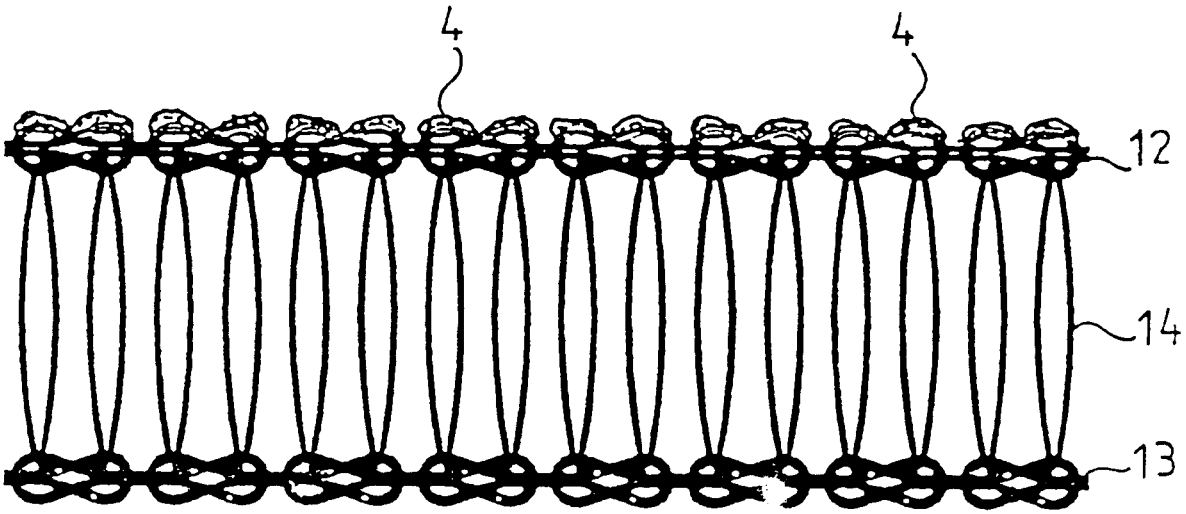
FIG. 13 shows a cross-sectional view of yet another, preferred embodiment of the grinding product according to the invention.

FIG. 13 shows a general view of a cloth that is a so-called spacer fabric, i.e. it consists of two woven, knitted or in some other similar way produced surface layers 12 and 13 which are connected to each other by connecting threads 14 that are essentially perpendicular to the plane of the surface layer and that are usually monofilaments. The distance between the surface layers 12, 13 is typically 1.5 to 30.0 mm. The surface layers are pervious to air, and they are essentially even on the outside.

The outside of the topmost surface layer 12 in FIG. 13 is coated with primarily separate agglomerates 4 of grinding material provided in the projecting parts of the knots and forming a non-continuous layer of grinding material on the cloth.

As distinct from FIG. 13, surface layer 13 can also be rendered impervious to air and dust. It is also possible to provide an air-pervious or air-impervious layer 13 with projecting loops for attaching the grinding product to a supporting surface comprising projecting fastening means. Surface layer 12 can also be provided with projecting loops or thread ends, to which agglomerates of grinding material can be applied. If surface layer 12 is provided with projecting thread parts to which a grinding agent is applied, the surface layer 12 may also be impervious to dust, since the thread parts form a gap between the surface to be ground and the surface layer 12 through which the dust can be removed. A grinding agent can also be applied to both surface layers 12, 13.

The threads that the cloth is made of can comprise continuous filaments or staple fibres or a mixture of these. The number of fibres per one thread can vary within certain limits, e.g. from one (monofilament) to several hundred, but it is typically between 10 and 30. The thickness of the cloth can vary in the embodiments of FIGS. 1 to 9 e.g. between 0.1 and 2.0 mm, and in the embodiments of FIGS. 10 and 11, between 0.2 and 10 mm. The loops and thread ends can project above the surface of the cloth a distance that corresponds to the thickness of the cloth or is several times longer. The fibre loops are preferably curved, whereas the fibre ends are advantageously crimped.

Alternatively, the projecting thread parts can be formed by whole threads 1 instead of one or more fibres 2 of threads.

Since the agglomerates of grinding material are separate, air, water and dust can pass between the agglomerates. This, however, does not make it impossible that some of the agglomerates are connected. FIGS. 1 to 7, 10 and 11 show accumulations of grinding material only in the projecting thread parts, but since it is in practice difficult to limit the grinding agent to these parts, agglomerates of grinding material also appear in the threads 1 of the cloth. Preferably, however, the grinding agent is provided at least primarily in the projecting thread parts.

When a surface is ground with a grinding product according to the invention, the agglomerates of grinding material are situated between the cloth and the surface to be ground. When the grinding direction or force is changed, the position of the projecting thread parts in relation to the cloth is also changed, whereby new sides of the grinding agent agglomerates come into contact with the surface to be ground. This is one of the main reasons for the long service life of the new grinding product. In addition, since the cloth is relatively loose, dust, water and air can easily flow through it. The conveyance of dust is also facilitated by the fact that the threads in a loose, woven or knitted cloth can move easily in relation to one another, which prevents the dust from blocking the cloth. Essentially the same advantages are achieved with the cloth shown in FIG. 6, even though the agglomerates are here not as mobile. Even here, however, the projecting thread parts 3, 5 on the opposite surface of the cloth, which is attached to a supporting surface, make it possible for the agglomerates to move considerably freely. In the embodiments of FIGS. 10, 11 and 12, it is the loose fabric that makes it possible for the agglomerates and threads of the cloth to move.

When the grinding product of FIG. 13 is used, surface layer 12 of the cloth is pressed against the surface to be ground and moved along the surface. The grinding dust produced passes between the agglomerates 4 and through surface layer 12 to the space between the surface layers, where the connecting threads 14 are situated. During the grinding, these threads move in relation to one another, which enhances conveyance of dust. The dust can be removed from the cloth through surface layer 13 and/or the edges of the cloth.

When a grinding agent is applied to both sides of the cloth, the roughness of the grinding agent on one side can differ from the roughness of the grinding agent on the other side, whereby it is possible to perform rough-grinding with one surface of the cloth and fine-grinding with the other surface.

A 'knitted cloth' here also refers to a crocheted cloth or the like.

We claim:

1. A grinding product comprising: a cloth of woven or knitted threads (1); thread parts, situated on one surface of the cloth and projecting from the cloth; and a grinding agent (4) applied as separate agglomerates on at least another essentially even surface of the cloth, wherein the projecting thread parts comprise loops (3) of threads (1) of the cloth, or of fibres (2) of such threads.

2. A grinding product according to claim 1, wherein opposite surfaces of the cloth comprise grinding agents, and wherein the grinding agents on the opposite surfaces of the cloth have different roughness.

3. A grinding product according to claim 1, wherein a reinforcing layer (9) is attached to a surface of the cloth that is free of grinding material.

4. A grinding product according to claim 1, wherein a liquid-absorbing layer is attached to a surface of the cloth that is free of grinding material.

5. A grinding product according to claim 4, wherein the liquid-absorbing layer comprises a foam plastic layer (11).

6. A grinding product according to claim 1, wherein the cloth is a spacer fabric comprising two essentially parallel woven or knitted surface layers (12, 13) spaced from each other, and connecting threads (14) that connect the surface layers to each other and that are essentially perpendicular to the surface layers, and wherein the grinding agent is applied in the form of separate agglomerates (4) at least to one surface layer (12) of the cloth.

* * * * *